US005820528A

United States Patent [19]

McAndrew

[11] Patent Number: 5,820,528

[45] Date of Patent: Oct. 13, 1998

[54] PADDLING ADAPTER ATTACHMENT APPARATUS FOR ROWING MACHINES

[76] Inventor: Mark Earl McAndrew, R.R. #1, Box 322, East Hardwick, Vt. 05836

[21] Appl. No.: 823,325

[22] Filed: Mar. 21, 1997

[51] Int. Cl.[6] ..... A63B 64/06

[52] U.S. Cl. ..... 482/72; 482/102; 482/121

[58] Field of Search ..... 482/71, 72, 129, 482/908, 99, 102

[56] References Cited

U.S. PATENT DOCUMENTS

| | | | |
|---|---|---|---|
| 4,725,055 | 2/1988 | Showronski | 482/908 |
| 4,867,440 | 9/1989 | Saarinen | 482/73 |
| 4,883,268 | 11/1989 | Salkind | 482/73 |
| 4,974,836 | 12/1990 | Hirsh | 482/102 |
| 5,042,798 | 8/1991 | Sawicky | 482/129 |
| 5,242,347 | 9/1993 | Keeton | 482/102 |
| 5,382,210 | 1/1995 | Rekers | 482/72 |
| 5,498,221 | 3/1996 | Blair, Jr. | 482/99 |
| 5,624,357 | 4/1997 | Englehart | 482/72 |

FOREIGN PATENT DOCUMENTS

| | | | |
|---|---|---|---|
| 1183559 | 3/1985 | Canada | 482/72 |

OTHER PUBLICATIONS

Fielder Drawings Figures 1 and 2, 161789.

*Primary Examiner*—Jerome Donnelly
*Attorney, Agent, or Firm*—Thomas N. Neiman

[57] ABSTRACT

The novel paddling adapter attachment apparatus for rowing machines is designed to be replaceably attached to a rowing machine in order to transform the rowing machine into a canoe paddling training device. The apparatus comprises a seating assembly that contains an adjustable seat and footrest that are mounted on a monorail unit. A separate paddling simulator unit contains sets of guide rollers for the unit's guide chain and the paddle rope attachment. A plurality of guide roller set are housed in a rear mast housing and also in the front mast housing. A travel pulley is used to attach the paddle rope attachment to the unit drive chain. The paddling adapter attachment apparatus is designed to be temporally attached easily and quickly and can be removed as easily and quickly from the rowing unit and allows the user to simulate the single blade, seated position canoeing stroke.

10 Claims, 3 Drawing Sheets

PADDLING ADAPTER ATTACHMENT APPARATUS FOR ROWING MACHINES

BACKGROUND OF THE INVENTION

This invention pertains to exercise machines and, in particular, to a paddling adapter attachment apparatus for use with rowing machines in order to provide individuals a simulated single blade seated position canoeing stroke exerciser that allows the stroke to take place on either side of the user.

The use of rowing machines as exercise and competition units is widespread with many units available for the purpose. One of the most well known units is the Concept II Model C Indoor rowing unit that is the subject of U.S. Pat. Nos. 4,396,188 and 4,875,674. Many serious rowers use that unit to maintain their physical fitness while continuing to work on their rowing form. These activities have not been available to those who desire to train on these machines and maintain their canoe paddling form. It is necessary for a unit that allows this activity to be very adaptable in that it must be easily and simply attachable to the rowing machine and must not alter the structure of the rowing machine. This will allow the user to use the machine as a rower unit and a paddled one in the same workout if he or she desires. Most importantly, the unit must provide an accurate simulation of the single blade, seated position canoeing stroke, allowing the stroke to take place on both the left and right sides of the user.

What is needed is a paddling adapter attachment apparatus for rowing machines that provides simulated single blade, seated position canoeing stroke for the individual using the device. What is also needed is a device that easily and quickly installs on a rowing machine and, at the same time, be easily and quickly removed from the rowing machine when desired by the user.

It is the object of this invention to teach a paddling adapter attachment apparatus for rowing machines device which avoids the disadvantages and limitations in previous paddling devices. Another object of this invention is to provide an apparatus that is cost effective, can be simply produced, quickly set up, easily removed and, at the same time, be safe and effective.

SUMMARY OF THE INVENTION

Particularly, it is the object of this invention to teach a paddling adapter attachment apparatus for rowing machines, for use in providing individuals a simulated single blade, seated position canoeing stroke that allows the stroke to take place on either side of the user, said structure comprising a seating assembly; said seating assembly having a horizontal support rail section, the horizontal support rail section having a seating platform for allowing the user a seat in order to provide support for the user; said seating assembly further having a foot support piece, the foot support piece comprising a resting platform for providing comfortable positioning for the individual's feet; said seating assembly further having adjustment means; a paddling simulator assembly; said paddling simulator assembly having drive means for propelling the resistance unit of the rowing machine; said paddling simulator assembly further having paddle connection means for connecting the user's paddle to said drive means; said paddling simulator assembly further having a plurality of roller units for permitting said drive means and said paddle connection means to operate smoothly; and said roller units having housings for containing said roller units therein.

BRIEF DESCRIPTION OF THE DRAWINGS

Further objects and features of this invention will become more apparent by reference to the following description taken in conjunction with the following figures, in which.

DETAILED DESCRIPTION OF THE PREFERRED EMBODIMENT

Figure 1:
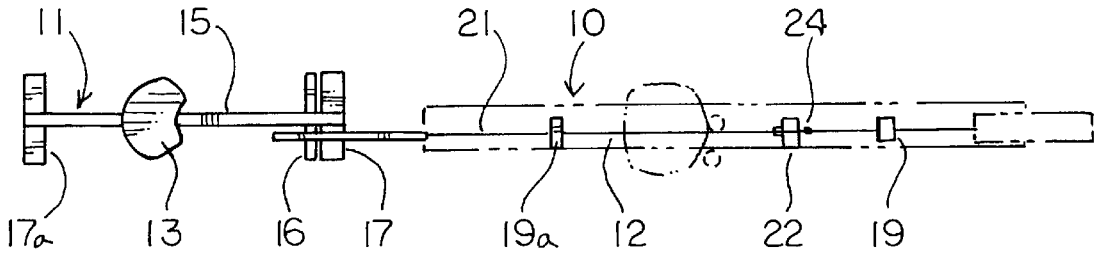
FIG. 1 is a top plan view of the novel paddling adapter attachment apparatus for rowing machines.
Figure 2:
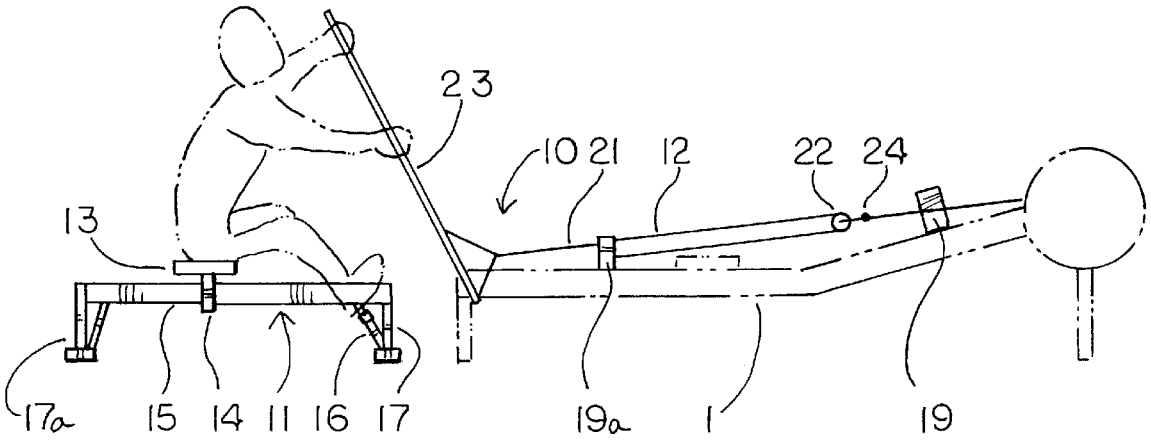
FIG. 2 is a side elevational view thereof.
Figure 4:
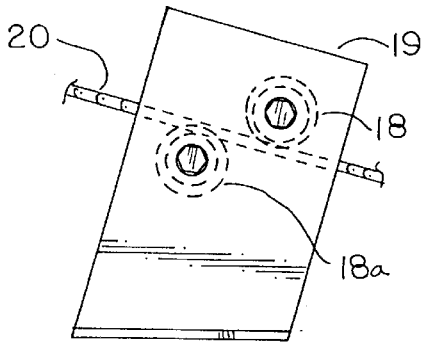
FIG. 4 is an enlarged side elevational view of the front mast assembly.
Figure 5:
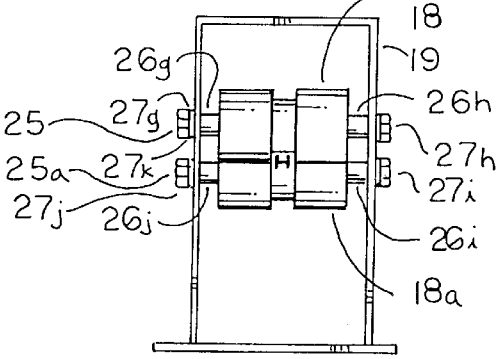
FIG. 5 is an enlarged front plan view thereof.
Figure 3:
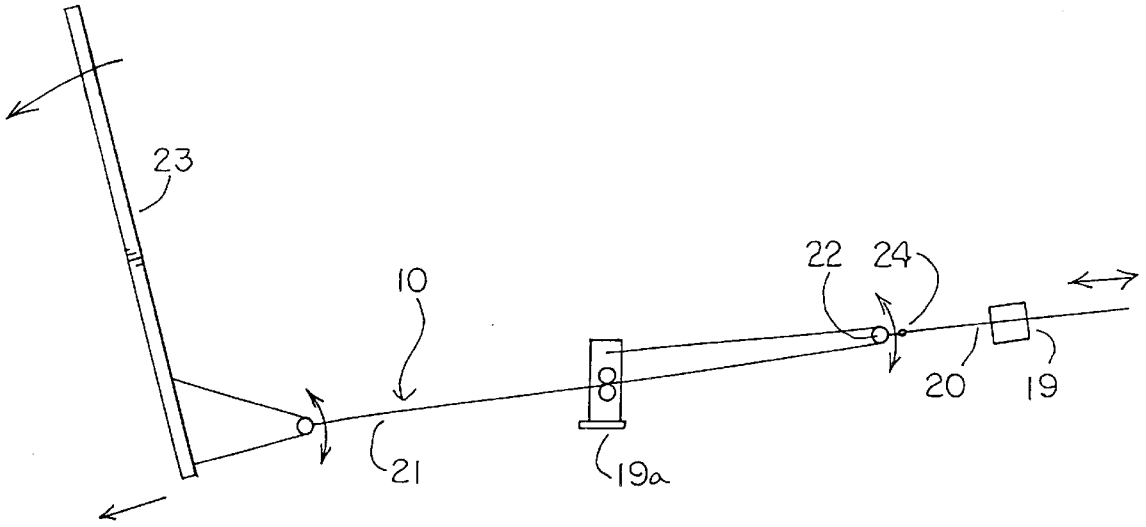
FIG. 3 is a force schematic of the apparatus.
Figure 6:
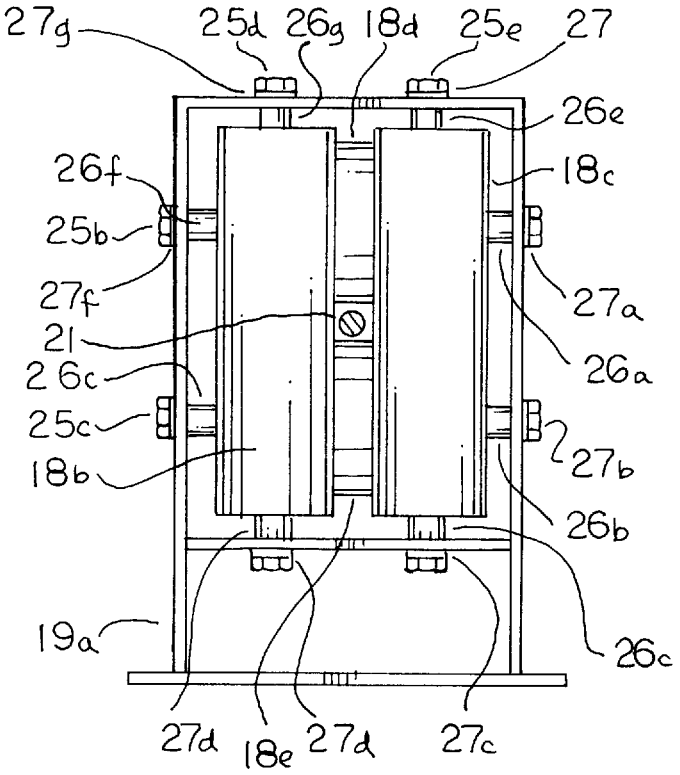
FIG. 6 is an enlarged front elevational view of the rear mast assembly.

As shown in the figures, the novel paddling adapter attachment apparatus 10 comprises two distinct components. The first component is a seating assembly 11 and a paddling simulator assembly 12. The seating assembly 11 comprises a seat 13 which is mounted by means of a frame 14 to a support structure 15 in the form of a monorail. The seat support frame 14 is adjustable in that it can be moved and positioned where desired along the rail 15 of the seating assembly 11. The seating assembly 11 has a footrest 16 that contains a height adjustment and is attached to the front base support 17 which provides vertical support for the seating assembly 11. The seating assembly also so has a rear base support 17*a*. The support frame 14 is height adjustable to allow for user comfort during use. The seating assembly 11 is a separate entity from the padding assembly 12.

The paddling assembly 12 is comprised a plurality of rollers 18 through 18*e* that are housed within a forward and rear frame or mast 19 and 19*a*. The rollers 18 through 18*e* act as guides for the drive chain 20 of the rowing machine 1 and the paddle connection rope 21. The rope 21 is connected on one end with the paddle shaft 23. The rope then passes through the opening through the rear mast frame 19 and the opening created between the rollers 18*b* through 18*e* and through a pulley 22 that is connected to the drive train 20 by a connector 24. The front mast frame 19*a* has an angled base which will allow the mast to rest perpendicularly to the floor surface. The front mast is affixed to the housing on the rowing machine. The rollers 18 through 18*e* in the front and rear mast frames 19 and 19*a* are high density polyurethane that are fitted with recessed sealed bearings and have axles 25 through 25*e* with spacers 26 through 26*k* and fitted washers 27 through 27*k* installed to insure smooth operation. The rollers 18 through 18*e* have seen machined with a center groove that is slightly larger than the drive chain 20 or the rope 21 to improve the operation of the apparatus 10. The rollers 18 and 18*a* of the front mast frame 19 are set horizontally. The rollers 18*b* thorough 18*e* in the rear mast housing 19*a* are positioned perpendicularly to each other (one set horizontal and one set vertical) to minimize the bouncing tendency of the rope and chain and allow the paddle shaft to be pulled from either side of the user. The paddling assembly 12 and the roller units 18 and 18*a* and 19 and 19*a* design does not restrict the pull of the paddle handle 23 to be used in a vertical plane defined by the drive sprocket and chain of the rowing machine. The rear set of rollers accomplishes this. The forward set of rollers is horizontal allowing the rope 21 to exit at an angle in the vertical plane. The rear set is vertical and each roller radius extends slightly beyond the housing which allows the rope 21 to exit at an angle in a horizontal plane. It is the opening created by this set of rollers that allows the drive chain to follow its normal path remaining in the vertical plane defined by the flywheel drive sprocket orientation, while at the same time, allow the paddle shaft 23 to pull the chain from a point outside that same vertical plane and thus properly simulate the canoe paddling stroke. The rear mast frame 19*a* is positioned on the rowing machine 1 behind the seat. Both mast frames are easily removed from the rowing machine for a quick conversion to be used as a rowing machine. The paddle connection rope 21 is anchored on the rear mast frame 19 after it has been looped around the pulley 22. The pulley reduces the load intended for the rowing mode by one half and increases the allowable length of the paddling stroke by a factor of two.

In operation the user will attach the two mast frames to the frame of the rowing machine and connects the paddling assembly to the drive chain. The seating assembly is than adjusted to the individual's tastes. The individual then sits on the seating assembly and begins to initiate the paddling motion. The simulated single blade, seated position canoe paddling that is created by the paddling adapter attachment apparatus allows the user to work on the form required for this purpose. It makes the rowing machine much more versatile. The drag created by the wind resistant weighted fly wheel of the rowing machine can be transferred from the rowing handle to the paddle shaft simulating the paddle stroke quite closely.

While I have described my invention in connection with specific embodiments thereof, it is clearly to be understood that this is done only by way of example and not as a limitation to the scope of my invention as set forth in the objects thereof and in the appended claims.

I claim:

1. A padding adapter attachment apparatus for rowing machines having a front angled portion and a horizontal support rail, for use in simulating a single blade, seated position canoeing stroke;

said paddling adapter attachment comprising:

a seating assembly; seating platform for allowing the user a seat in order to provide support for the user;

said assembly having a horizontal support rail section, the support rail section having a said seating assembly further having a foot support piece, the foot support piece comprising a resting platform for providing comfortable positioning for the individual's feet;

said seating assembly further having adjustment means;

a paddling simulator assembly;

said paddling simulator assembly having drive means for propelling the resistance unit of the rowing machine;

said paddling simulator assembly further having paddle connection means for connecting the user's paddle to said drive means;

said paddling simulator assembly further having a plurality of roller units for permitting said drive means and said paddle connection means to operate smoothly;

said plurality of rollers comprising sets of rollers, said sets of rollers comprising a first unit of sets of rollers and a second unit of sets of rollers;

said first unit and said second unit having separate housings;

said housing containing said first unit of roller sets adapted to being positioned on the front angled portion of said rowing machine for guiding said drive means passing through said plurality of roller units;

said housing containing said second unit of roller sets adapted to being positioned on said horizontal support rail of said rowing behind the seating platform, permitting said paddle connection means to transmit the resistance of said paddling simulator assembly in all planes to said user's paddle;

said first unit of said roller sets being oriented horizontally within said housing of said first unit of said roller sets;

at least one set of rollers of said second unit of said roller sets being oriented vertically within said housing of said second unit of said roller sets.

2. A paddling adapter attachment apparatus for rowing machine, according to claim 1 wherein said second unit of said roller sets include an additional set of rollers which are oriented vertically within said housing of said second unit of said roller sets.

3. A paddling adapter attachment apparatus for rowing machines, according to claim 1, wherein:

said horizontal support rail section of said seating assembly comprises a unit of monorail construction, positioned under said seating platform; and said horizontal support rail section of said seating assembly having vertical support pieces.

4. A paddling adapter attachment apparatus for rowing machines, according to claim 1, wherein:

said seating platform having a connection frame for attaching said seating platform to said horizontal support rail section.

5. A paddling adapter attachment apparatus for rowing machines, according to claim 3, wherein:

said foot support piece comprises angled platforms attached to said vertical support pieces.

6. A paddling adapter attachment apparatus for rowing machines, according to claim 1, wherein:

said adjustment means of said seating assembly comprises first means for positioning said seating platform on said horizontal support rail piece;

said adjustment means of said seating assembly further comprises second means for positioning the elevation of said seating assembly; and said adjustment means of said seating assembly further comprises third means for positioning the elevation of said foot support piece.

7. A paddling adapter attachment apparatus for rowing machines, according to claim 1, wherein:

said drive means comprises a drive chain.

8. A paddling adapter attachment apparatus for rowing machines, according to claim 1, wherein:

said paddle connection means comprises a rope unit attached to said paddle shaft;

said rope unit having pulley means connecting said rope unit to said drive chain.

9. A paddling adapter attachment apparatus for rowing machines, according to claim 1, wherein:

said sets of rollers have roller bearings;

said sets of rollers further having washers;

said sets of rollers further having spacers positioned for insuring freedom of movement of said sets of rollers; and said sets of rollers further having axle means.

10. A paddling adapter attachment apparatus for rowing machines, according to claim 1, wherein:

said roller unit housings comprise means for allowing said housings to be perpendicular to the floor surface; and said roller unit housings having quick release attachment means for ease of connecting said roller unit housing to said rowing machine and ease of removal of said roller unit housings from said rowing machine.

* * * * *